US008200120B2

(12) United States Patent
Sato

(10) Patent No.: US 8,200,120 B2
(45) Date of Patent: Jun. 12, 2012

(54) IMAGE FORMING APPARATUS HAVING AN INTERMEDIATE TRANSFER BELT DISPOSED ABOVE A PLURALITY OF PHOTOCONDUCTORS

(75) Inventor: Shougo Sato, Seto (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 580 days.

(21) Appl. No.: 12/339,784

(22) Filed: Dec. 19, 2008

(65) Prior Publication Data

US 2009/0169252 A1 Jul. 2, 2009

(30) Foreign Application Priority Data

Dec. 27, 2007 (JP) ..... 2007-337005

(51) Int. Cl.
*G03G 15/00* (2006.01)
*G03G 15/16* (2006.01)
*G03G 21/18* (2006.01)

(52) U.S. Cl. ..... 399/110; 399/111; 399/121

(58) Field of Classification Search ..... 399/110, 399/111, 121, 124
See application file for complete search history.

(56) References Cited

U.S. PATENT DOCUMENTS 6,978,103 B2 12/2005 Miura et al.
7,379,687 B2 * 5/2008 Kawasumi ..... 399/110
7,447,467 B2 11/2008 Kamimura et al.
7,720,413 B2 5/2010 Kamimura et al.
7,986,904 B2 * 7/2011 Okabe ..... 399/121
8,064,793 B2 11/2011 Kamimura et al.
2006/0140673 A1 6/2006 Kamimura et al.
2006/0140674 A1 6/2006 Sato

FOREIGN PATENT DOCUMENTS

JP 03084837 U 8/1991
JP 2000321843 A 11/2000
JP 2003287992 10/2003
JP 2003316233 11/2003
JP 2006171534 A 6/2006
JP 2006184552 7/2006
JP 2006184552 A 7/2006
JP 2006184553 7/2006

OTHER PUBLICATIONS

Japanese Office Action dated Jan. 31, 2012, issued in the counterpart JP Patent Application No. 2007-337005.

* cited by examiner

*Primary Examiner* — William J Royer
(74) *Attorney, Agent, or Firm* — Banner & Witcoff, Ltd.

(57) ABSTRACT

In an image forming apparatus, a support frame is configured to support a plurality of photoconductors arranged in the apparatus, the support frame being allowed to be pulled out from a casing of the apparatus, and an intermediate transfer belt is disposed above the plurality of photoconductors and configured to be movable between a contact position in which the intermediate transfer belt is in contact with each of the plurality of photoconductors and a separate position in which the intermediate transfer belt is separate from the each of the plurality of photoconductors. A predetermined amount of upward movement of the support frame made when the intermediate transfer belt is or comes in the separate position renders the support frame operable to be pulled out in a direction of arrangement of the plurality of photoconductors.

18 Claims, 6 Drawing Sheets

IMAGE FORMING APPARATUS HAVING AN INTERMEDIATE TRANSFER BELT DISPOSED ABOVE A PLURALITY OF PHOTOCONDUCTORS

CROSS-REFERENCE TO RELATED APPLICATION(S)

This application claims the foreign priority benefit under Title 35, United States Code, §119 (a)-(d), of Japanese Patent Application No. 2007-337005 filed on Dec. 27, 2007 in the Japan Patent Office, the disclosure of which is herein incorporated by reference in its entirety.

BACKGROUND OF THE INVENTION

1. Field of the Invention

The present invention relates to an image forming apparatus which includes a support frame for supporting a plurality of photoconductors arranged in the apparatus, the support frame being allowed to be pulled out from a casing of the apparatus.

2. Description of Related Art

The so-called tandem type image forming apparatus typically includes a support frame for supporting a plurality of photoconductor drums arranged in a horizontal direction, wherein the support frame is allowed to be pulled out from a casing of the apparatus (e.g., through a front or side panel of the casing) so that each photoconductor drum can be easily installed into and removed from a main body of the apparatus. Such an image forming apparatus, for example, as disclosed in JP 2003-316233 A and JP 2003-287992 A (corresponding U.S. patent issues under U.S. Pat. No. 6,978,103 B2), has an intermediate transfer belt in contact with a top side of each photoconductor drum, and is thus configured such that when a support frame (a member for holding image-carrying members) is pulled out from a casing of the apparatus, it is pulled out straight in a horizontal direction after the intermediate transfer belt (a member for carrying a transfer agent) is moved away upwardly.

In this configuration where the support frame is pulled out straight in a horizontal direction, the support frame would possibly be shifted horizontally in position within the apparatus through an operation of the support frame pulled out from and pushed into the casing of the apparatus, whereby the photoconductor drums could disadvantageously be positioned inaccurately relative to the other components of the main body of the apparatus. The resulting inaccurate positioning of the photoconductor drums in the apparatus would cause unnecessarily greater forces to act on both of the photoconductor drums and the intermediate transfer belt at their contact surfaces, or make a gap therebetween, which would undesirably produce a problem transferring an image, resultantly lowering the quality of the image.

It would thus be desirable to provide an image forming apparatus, in which the photoconductor drums can be positioned accurately relative to other components of the main body of the apparatus while maintaining the ease of operation of the support frame being pulled out from and pushed into the casing of the apparatus. The present invention has been made in an attempt to eliminate the above disadvantages. Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

SUMMARY OF THE INVENTION

In one aspect of the present invention, there is provided an image forming apparatus comprising a plurality of photoconductors; a support frame configured to support the plurality of photoconductors arranged in the apparatus, the support frame being allowed to be pulled out from a casing of the apparatus; and an intermediate transfer belt disposed above the plurality of photoconductors and configured to be movable between a contact position in which the intermediate transfer belt is in contact with each of the plurality of photoconductors and a separate position in which the intermediate transfer belt is separate from the each of the plurality of photoconductors, wherein a predetermined amount of upward movement of the support frame made when the intermediate transfer belt is or comes in the separate position renders the support frame operable to be pulled out in a direction of arrangement of the plurality of photoconductors.

With the image forming apparatus configured as described above, the support frame can be pulled out from the casing of the apparatus, so that the support frame can be easily installed into and removed from the apparatus. Moreover, the support frame is configured to be pulled out after the support frame is moved upward by a predetermined amount; thus when the support frame is to be installed into the apparatus, the support frame is pushed into the casing and then moves downward (drops). Accordingly, the support frame once installed and positioned in the apparatus is prevented from further moving horizontally, with the result that the photoconductors supported by the support frame can be positioned accurately relative to the other components of the main body of the apparatus.

It is to be understood that the "upward" as a direction of movement of the support frame made by a predetermined amount is not limited to a vertically upward direction, but encompasses any of obliquely upward directions.

According to the specific embodiments of the present invention as will be described below, the plurality of photoconductors can be positioned accurately relative to the other components of the main body of the apparatus without diminishing the ease of operation of installation or removal of the support frame. Consequently, high image quality can be maintained without fail.

BRIEF DESCRIPTION OF THE DRAWINGS

The above aspect and advantages, other advantages and further features of the present invention will become more apparent by describing in detail illustrative, non-limiting embodiments thereof with reference to the accompanying drawings, in which.

DETAILED DESCRIPTION OF THE EXEMPLARY EMBODIMENTS

Figure 1:
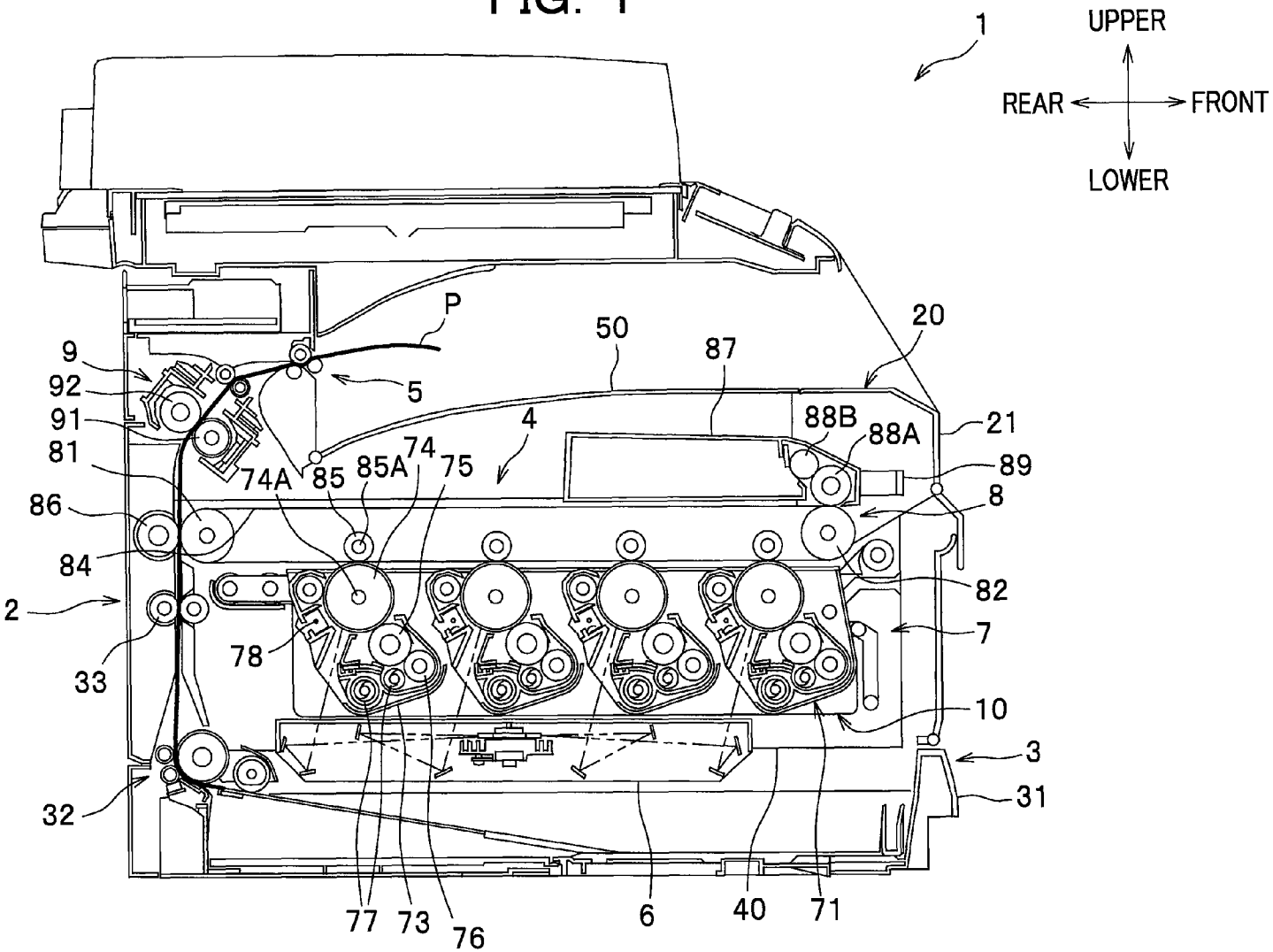
FIG. 1 a schematic diagram of a color printer (all-in-one or multifunction printer) as one example of an image forming apparatus according to an exemplary embodiment of the present invention.

A detailed description will be given of one exemplary embodiment of the present invention with reference to the drawings. In the following description, the direction is designated as from the viewpoint of a user who is using (operating) a color printer. To be more specific, in FIG. 1, the right-hand side of the drawing sheet corresponds to the "front side" of the color printer (image forming apparatus), and the left-hand side of the drawing sheet corresponds to the "rear side" of the color printer, the front side of the drawing sheet corresponds to the "left side" of the color printer, and the back side of the drawing sheet corresponds to the "right side" of the color printer. Similarly, the direction of a line extending from top to bottom of the drawing sheet corresponds to the "vertical direction" of the printer.

As shown in FIG. 1, a color printer 1 comprises a body casing 2 which makes up a housing of a main body of the printer 1, and the main body housed within the body casing 2 principally includes a sheet feeder unit 3, an image forming unit 4 and a sheet output unit 5. The sheet feeder unit 3 is configured to feed a sheet P of paper (recording sheet) to the image forming unit 4. The image forming unit 4 is configured to form an image on a sheet P fed from the sheet feeder unit 3. The sheet output unit 5 is configured to eject a sheet P on which an image has been formed in the image forming unit 4 to the outside of the body casing 2. Provided at a top side of the body casing 2 is a sheet output tray 50, as one example of an output sheet receptacle, which is configured to receive sheets P ejected by the sheet output unit 5 one by one through the body casing 2 so that the ejected sheets P are stacked and accumulated in the sheet output tray 50.

The sheet feeder unit 3 includes a sheet feed tray 31, a sheet feed mechanism 32, and a pair of registration rollers 33. The sheet feed tray 31 is provided in a lower space within the body casing 2, and is detachably attached to the body casing 2. The sheet feed mechanism 32 is configured to separate one sheet P from the sheets stacked in the sheet feed tray 31 and feed the separated sheet P upward to the registration rollers 33. The sheet feed mechanism 32 is composed of known components which include a sheet feed roller, a separation roller, a separation pad, a paper powder remover roller, and the like, (reference numerals of which are omitted). The sheet P thus fed from the sheet feed mechanism 32 is put in proper alignment, so that the edge of the sheet P is neatly aligned, by the registration rollers 33, and is then conveyed to the image forming unit 4.

The image forming unit 4 includes a scanner unit 6, a process unit 7, a transfer unit 8 and a fixing unit 9.

The scanner unit 6 is provided in a lower space within the body casing 2, to be more specific, between the sheet feed tray 31 and the process unit 7, and composed of known components which include a laser light-emitting device, a polygon mirror, a plurality of lenses and reflecting mirrors (reference numerals of which are omitted). In the scanner unit 6, laser beams for cyan, magenta, yellow and black emitted from the laser light-emitting devices of the corresponding colors travel paths as indicated by chain double-dashed lines of FIG. 1, and strike the corresponding photoconductor drums 74 in the process unit 7, respectively.

The process unit 7 is disposed above the scanner unit 6, to be more specific, between the scanner unit 6 and the transfer unit 8, and includes a support frame 10, a plurality of development devices 71 disposed in the support frame 10, and a plurality of developer cartridges 72 (see FIG. 2) disposed at a left side (an outside of a left side panel) of the support frame 10 and detachably attached to the body casing 2.

The support frame 10 is installed in the body casing 2 in such a manner that the support frame 10 can be pulled out in a front-rear direction from the body casing 2. A plurality of (four in this embodiment) development devices 71 are arranged in the support frame 10 in a front-rear direction. A detailed description of the construction and operation of the support frame 10 will be given later.

Figure 2:
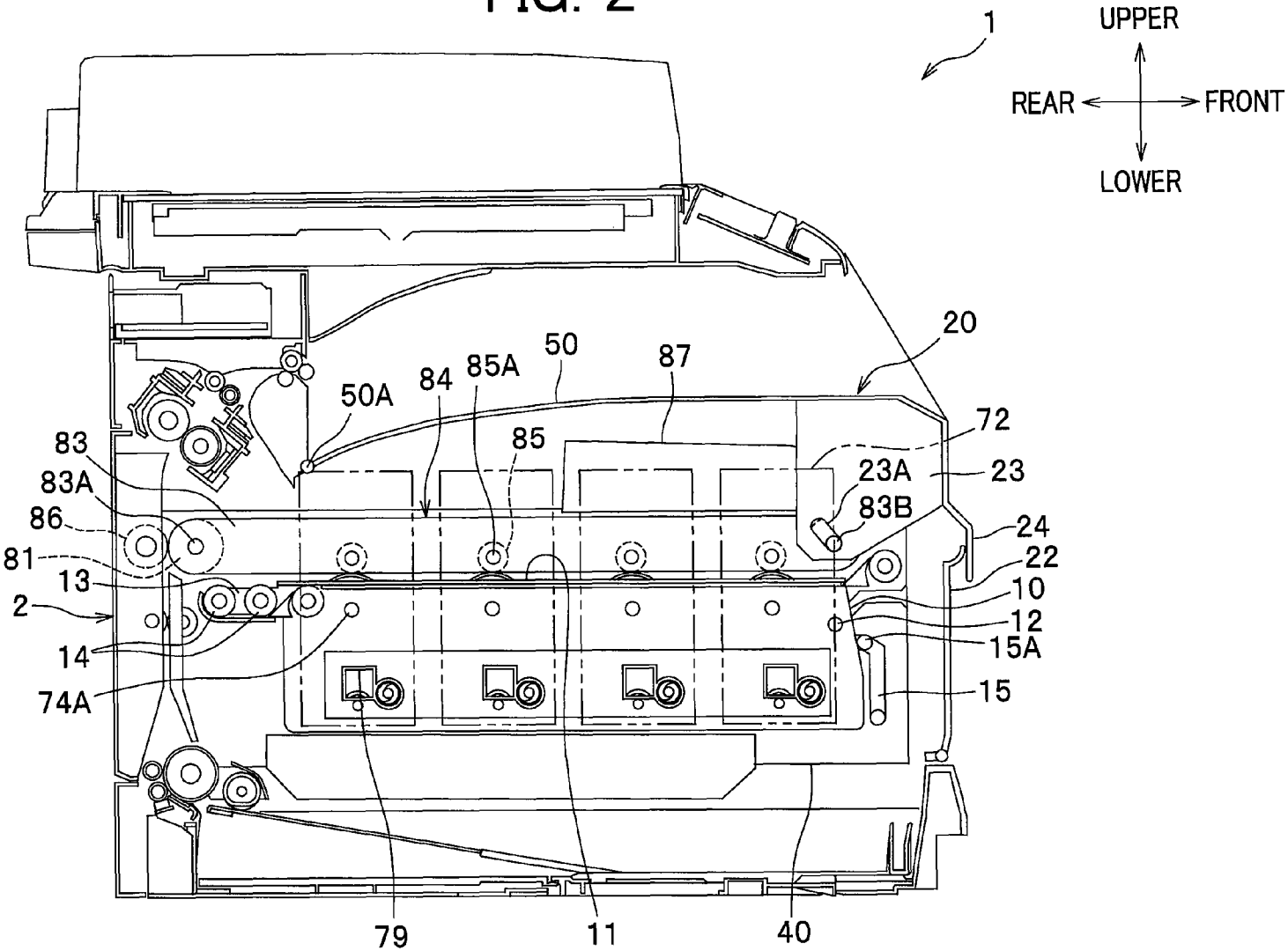
FIG. 2 is a diagram structurally illustrating a support frame and an upper cover of the color printer of FIG. 1.

Each of the development devices 71 principally includes a device case 73, a photoconductor drum 74 as one example of a photoconductor, a development roller 75, a supply roller 76, a pair of conveyor augers 77 and a charger 78; these components 74, 75, 76, 77 and 78 are provided in the device case 73. Each photoconductor drum 74 has its shaft 74A supported by the support frame 10 as shown in FIG. 2.

Provided in left sidewalls of the device cases 73 abutting face-to-face on the left side panel of the support frame 10 at its lower portion are openings 79 each of which connects the inside of the development device 71 and the outside of the support frame 10. Each opening 79 is connected with an opening (not shown) formed in a corresponding developer cartridge 72. Toner (developer) in the developer cartridge 72 is allowed to be supplied through the opening of the developer cartridge 72 and the opening 79 to the corresponding development device 71, and to be circulated back from the development device 71 to the developer cartridge 72. The development devices 71 are different from one another solely in color of toner to be supplied from the corresponding developer cartridge 72, and have substantially the same construction.

In the process unit 7 configured as described above, an outer cylindrical surface of each photoconductor drum 74 is uniformly charged by the corresponding charger 78, and is then selectively illuminated with a laser beam emitted from the scanner unit 6, so that a potential of an illuminated area of the surface of the photoconductor drum 74 is lowered to form an electrostatic latent image thereon in accordance with image data. Meanwhile, toner in each developer cartridge 72 shown in FIG. 2 is supplied through the opening 79 into the corresponding development device 71, and the toner supplied into the development device 71 is forwarded by the conveyor auger 77 and the supply roller 76 to the development roller 75. The toner thus supplied to the development roller 75 is then supplied to the surface of the photoconductor drum 74 and retained selectively on that area of the photoconductor drum 74 in which an electrostatic latent image has been formed, to thereby visualize the electrostatic latent image, forming a toner image thereon.

The transfer unit 8 is disposed, as shown in FIG. 1, above the process unit 7, and includes a driving roller 81, a driven roller 82, a belt frame 83 (see FIG. 2), an intermediate transfer belt 84, four primary transfer rollers 85, a secondary transfer roller 86, and a cleaning unit 87 as one example of a residual developer collecting member.

The driving roller 81 and the driven roller 82 laid with their axes extending laterally in parallel are arranged separately and supported by the belt frame 83 in front and rear positions in the body casing 2 (see FIG. 2); the intermediate transfer belt 84 in the form of an endless belt is looped around the driving roller 81 and the driven roller 82. The intermediate transfer belt 84 is driven by the rotary motion of the driving roller 81 and is rotated together with the driven roller 82.

Each of the primary transfer rollers 85 is provided inside the intermediate transfer belt 84 in a position directly opposite to a corresponding photoconductor drum 74 such that the intermediate transfer belt 84 is held between the primary transfer roller 85 and the corresponding photoconductor drum 74. Each primary transfer roller 85 is supported, rotatably on its shaft 85A, by the belt frame 83 (see FIG. 2). During a transfer operation, a transfer bias is applied to each primary transfer roller 85 by a constant-current control. Accordingly, toner images formed on the respective photoconductor drums 74 are transferred, one on top of another, onto the intermediate transfer belt 84.

The secondary transfer roller 86 is disposed rearwardly opposite to the driving roller 81 with the intermediate transfer belt 84 held between the secondary transfer roller 86 and the driving roller 81. A transfer bias is also applied to the secondary transfer roller 86 by a constant-current control during the transfer operation. Accordingly, the toner image on the intermediate transfer belt 84 is transferred onto a sheet P conveyed upwardly from the registration rollers 33.

Figure 3:
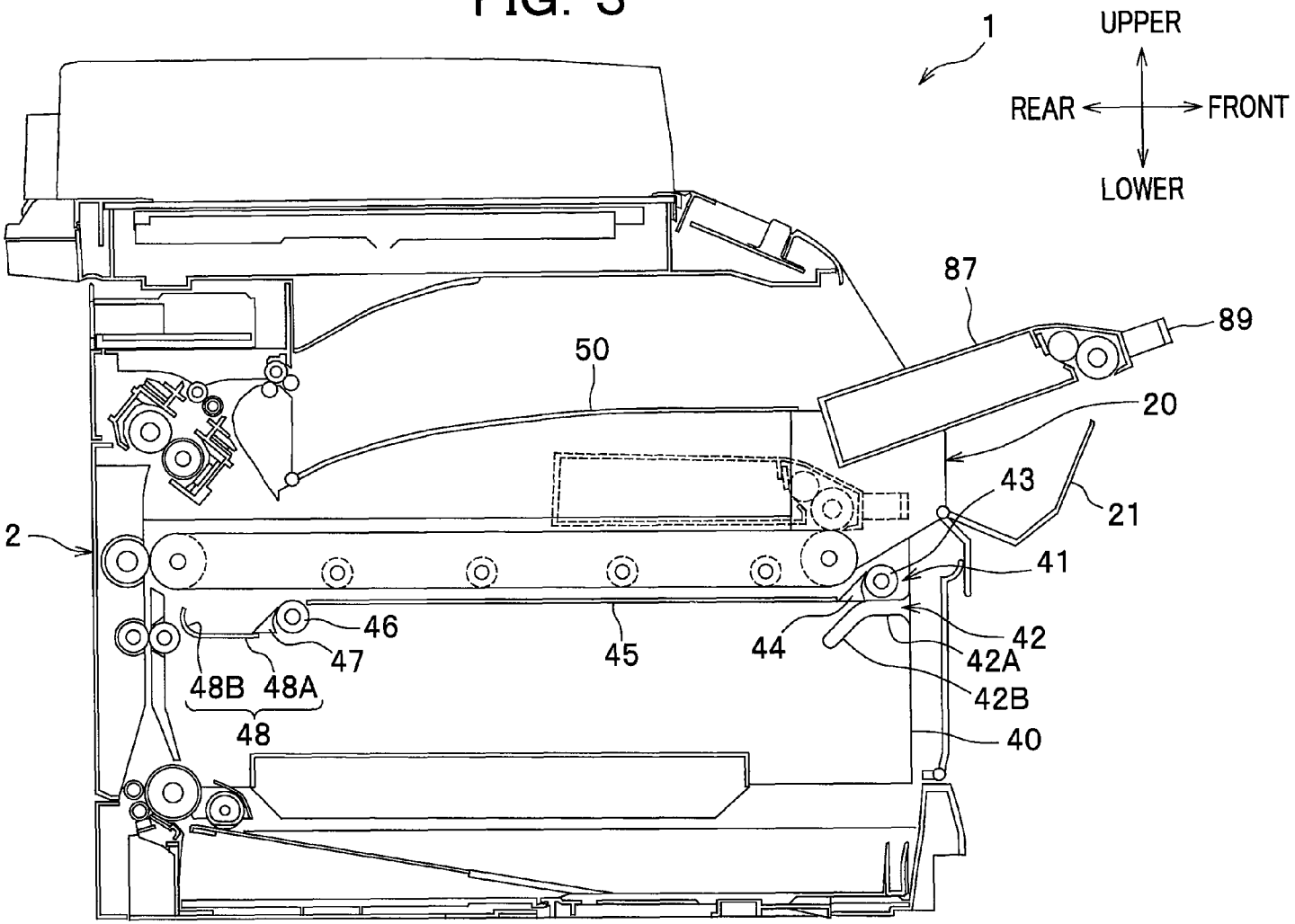
FIG. 3 is a diagram illustrating a structure of a side frame of the color printer of FIG. 1.

The cleaning unit 87 is disposed above the intermediate transfer belt 84, and is configured to collect residual toner adhering to the intermediate transfer belt 84 by means of a first cleaning roller 88A and a second cleaning roller 88B and to store the collected toner therein. A handle 89 is provided at a front side of the cleaning unit 87. The cleaning unit 87 is configured to be replaceable as shown in FIG. 3; in operation, a first front cover 21 provided at a right-side upper and front corner of the upper portion (upper cover 20) of the body casing 2 is swung open, so that the handle 89 of the cleaning unit 87 can be grabbed to remove the cleaning unit 87 from inside the body casing 2 (see FIG. 3).

The fixing unit 9 is disposed along a sheet conveyance direction downstream of the transfer unit 8 (to be more specific, above the secondary transfer roller 86), and includes a heating roller 91 and a pressure roller 92, which are configured as known in the art. In the fixing unit 9, through the process of pinching and forwarding a sheet P, on which a toner image has been formed, between the heating roller 91 and the pressure roller 92, the toner image is thermally fixed on the sheet P.

The sheet output unit 5 includes a plurality of conveyor rollers (reference numerals thereof are omitted). The sheet P ejected from the fixing unit 9 is conveyed by the conveyor rollers to the outside of the body casing 2, and stacked and accumulated on the sheet output tray 50.

The structures of the support frame 10 and the body casing 2 according to an exemplary embodiment of the present invention will now be described in detail.

As shown in FIG. 2, the support frame 10 is shaped like a box with its upper side open. Upper end portions of the right and left panels of the support frame 10 are bent outward (rightward and leftward, respectively) substantially at right angles to form flanges 11. Furthermore, projections 12 extending outward (rightward and leftward, respectively) are provided in positions at the outsides of the right and left panels of the support frame 10 closer to front ends thereof. Also provided at the outsides of the right and left panels of the support frame 10 are roller mount portions 13 which project rearward from upper positions of rear ends of the right and left panels. On each of the roller mount portions 13, two rotatable guide rollers 14 projecting outward (rightward or leftward) are arranged in front-rear direction.

A substantially U-shaped handle 15 designed specifically to be grasped by a user who is about to pull out the support frame 10 is provided at a front side of the support frame 10. The handle 15 is swingably joined to a front panel of the support frame 10 by means of a handle shaft 15A so that the handle 15 can be folded down about the handle shaft 15A when the support frame 10 has been installed in the body casing 2.

The body casing 2 includes an upper cover 20 which is configured to be upwardly swung open, a second front cover 22 as one example of a cover consistent with the present invention as claimed, and side frames 40 configured to support the support frame 10 in such a manner that the support frame 10 can be pulled out from the body casing 2.

The upper cover 20 is a member which makes up an upper portion of the body casing 2 and in which components of the transfer unit 8 except the secondary transfer roller 86, and support members 23 for supporting those components of the transfer unit 8 at an underside of the sheet output tray 50 are housed. In other words, the upper cover 20 and the components of the transfer unit 8 (except the secondary transfer roller 86) constitute an upper cover assembly that is movable together.

The upper cover assembly has two shafts 50A and 83A in positions closer to a rear end thereof; to be more specific, the upper cover 20 and the components of the transfer unit 8 except the secondary transfer roller 86 are configured to be swingable on shafts 50A and 83A, respectively, which are supported by the body casing 2. The shaft 83A, which is one example of a first axis of a swinging motion of the intermediate transfer belt 84, projects outward laterally (rightward and leftward) from a position of the belt frame 83 closer to a rear end thereof. To be more specific, the shaft 83A is located on the same axis as that of the shaft of the driving roller 81 supported by the belt frame 83, in the present embodiment. The shaft 50A, which is one example of a second axis of a swinging motion of the upper cover 20, is disposed in a position at a rear end of the sheet output tray 50 and below the sheet output unit 5. The upper cover 20 is configured to be swingable upward on the shaft 50A together with the support members 23 which support the belt frame 83 configured to be swingable upward on the shaft 83A. That is, the upper cover assembly is swingable upward on the shafts 50A and 83A (see FIG. 4).

The support members 23 are provided at right and left sides of a front portion of the upper cover 20 frontward of the sheet output tray 50, and configured to support the belt frame 83, thereby supporting the intermediate transfer belt 84, primary transfer rollers 85, cleaning unit 87 and other components. Each support member 23 has an oblong support hole 23A elongated obliquely in an upward and rearward direction as viewed when the upper cover 20 is in a closed position. On the belt frame 83, support projections 83B are provided which project outward laterally (rightward and leftward) from a position of the belt frame 83 closer to a rear end thereof. Since the support projections 83B are inserted (loosely fitted) in the support holes 23A of the support members 23, the support projections 83B are movable relatively in the support holes 23A in directions closer to and away from the shaft 50A, and the belt frame 83 is supported by the support members 23. It is to be understood that the support projections 83B are located on the same axis as that of the shaft of the driven roller 82 (see FIG. 1) supported by the belt frame 83, in the present embodiment.

Figure 4:
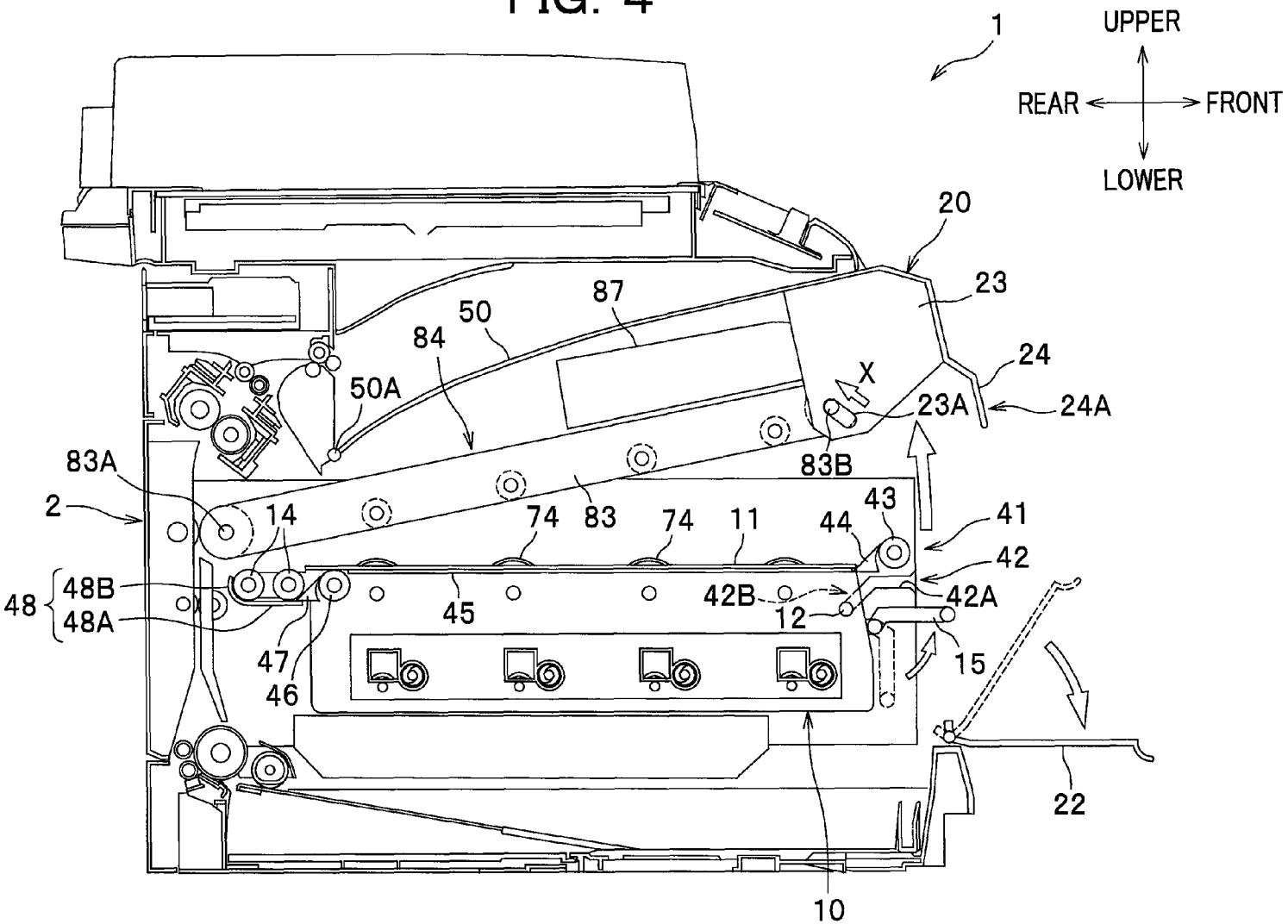
FIG. 4 is a diagram of an upper cover and a second front cover, which have been swung open, of the color printer of FIG. 1.

The second front cover 22 is configured to be swingable frontward and rearward on a pivot provided at a lower end thereof (see FIG. 4). A front panel 24 is provided in the upper cover 20, and serves as one example of a cover restriction member. The front panel 24 of the upper cover 20 is configured to rest on an upper end portion of the second front cover 22 as shown in FIG. 2 when the upper cover 20 is in a closed position, to thereby restrict a swinging (opening) motion of the second front cover 22 so that the second front cover 22 is not allowed to be swung open unless the upper cover 20 is swung upwardly. Since the second front cover 22 is prevented from being swung open when the upper cover 20 is closed and the photoconductor drums 74 are in contact with the intermediate transfer belt 84, a user would never be allowed to pull out the support frame 10 and thus any damage to the photoconductor drums 74 and the intermediate transfer belt 84 would be prevented.

As shown in FIG. 3, the side frames 40 are provided at right and left sides within the body casing 2, and each comprise a guideway portion 41 and a guide recess 42.

The guideway portion 41 is a portion along which the guide rollers 14 and the flanges 11 are guided when the support frame 10 is installed into or removed from the body casing 2, and comprises, from the front: a first roller 43; a first guide 44; a guide rail 45 and a second roller 46 which are configured to serve as one example of a first guide part; and a second guide 47 and a positioning portion 48 which are configured to serve as one example of a second guide part. An upper surface (rolling surface) of the first roller 43, an upper surface of the first guide 44, an upper surface of the guide rail 45, an upper surface (rolling surface) of the second roller 46, and an upper surface of the second guide 47 are arranged to constitute a single continuous guide surface.

The first roller 43 is a cylindrical roller. The upper surface of the first guide 44 slopes down rearward from a rear end of the upper surface of the first roller 43. The guide rail 45 extends substantially horizontally in a front-rear direction, and the second roller 46 is a cylindrical roller whose upper surface (rolling surface) is substantially flush with the upper surface of the guide rail 45. The upper surface of the second guide 47 slopes down rearward from a rear end of the upper surface of the second roller 46. The positioning portion 48 comprises a substantially horizontally extending flat segment 48A and a substantially arc-shaped rear-end segment 48B which are integrally formed in one piece.

The guide recess 42 is a portion for guiding and positioning the projection 12 of the support frame 10, and comprises a flat section 42A extending substantially horizontally from a front end of the side frame 40 rearward, and a sloped section 42B extending from a rear end of the flat section 42A obliquely in a rearward and downward direction.

Operation and advantages of the color printer 1 configured as described above will be described hereafter with reference to FIGS. 4, 5 and 6.

When the support frame 10 is to be removed from the body casing 2, first, an overhang 24A formed in the front panel 24 of the upper cover 20 is held (with user's fingers slid thereunder), and the upper cover 20 (upper cover assembly) is manually swung upwardly as shown in FIG. 4. Accordingly, the intermediate transfer belt 84, the cleaning unit 87 and the sheet output tray 50 are swung upwardly together, and the intermediate transfer belt 84 is moved from a contact position (see FIG. 2) in which the intermediate transfer belt 84 is in contact with the photoconductor drums 74 to a separate position in which the intermediate transfer belt 84 is separate from the photoconductor drums 74.

In this operation, the support projections 83B are relatively moved obliquely upwardly along the slope of the support holes 23A (in a direction indicated by arrow X in FIG. 4), i.e., in a direction toward the shaft 50A, and thus the belt frame 83 (intermediate transfer belt 84) and the cleaning unit 87 are moved toward the sheet output tray 50.

With the help of the aforementioned structures of the support projections 83B and the support holes 23A, the upper cover assembly having two shafts 83A and 50A can be swung smoothly; i.e., the upper cover 20 can be swung together with the intermediate transfer belt 84 and the other components on two axes (shafts 83A and 50A) of the swinging motion. Since the upper cover assembly (the upper cover 20 and the components housed therein) is supported by the two shafts 83A and 50A, the upper cover 20 and the components are stably supported on the body casing 2, and the rigidity of the upper cover assembly, and of the body casing 2 as well, can be enhanced.

Since the support holes 23A are each formed to have a sloped shape which extends in an obliquely upward and rearward direction, the intermediate transfer belt 84 can be moved closer to the sheet output tray 50 when the upper cover assembly is swung open, in comparison with an alternative embodiment in which the support holes are each formed to have a shape which extends in a substantially horizontal direction. It can thus be ensured that the intermediate transfer belt 84 is sufficiently separated from each of the photoconductor drums 74.

After the upper cover assembly is swung upward, the second front cover 22 is downwardly swung open as shown in FIG. 4 to render the support frame 10 accessible. Then, the handle 15 of the support frame 10 is swung upward so that the grip of the handle 15 is moved in a substantially horizontal position.

Next, the handle 15 of the support frame 10 is grasped and pulled to the front. This operation causes the guide rollers 14 to move in an obliquely upward and frontward direction (indicated by an arrow) along the second guide 47 as shown in FIG. 5, and the support frame 10 moves from a position determined by the positioning portion 48 (flat segment 48A) upwardly (in an obliquely upward direction) to a position in which lower surfaces of guide rollers 14 are raised to a level of the upper surface of the guide rail 45. At this time, an underside of the flange 11 is brought into contact with the rolling surface of the first roller 43.

Figure 6:
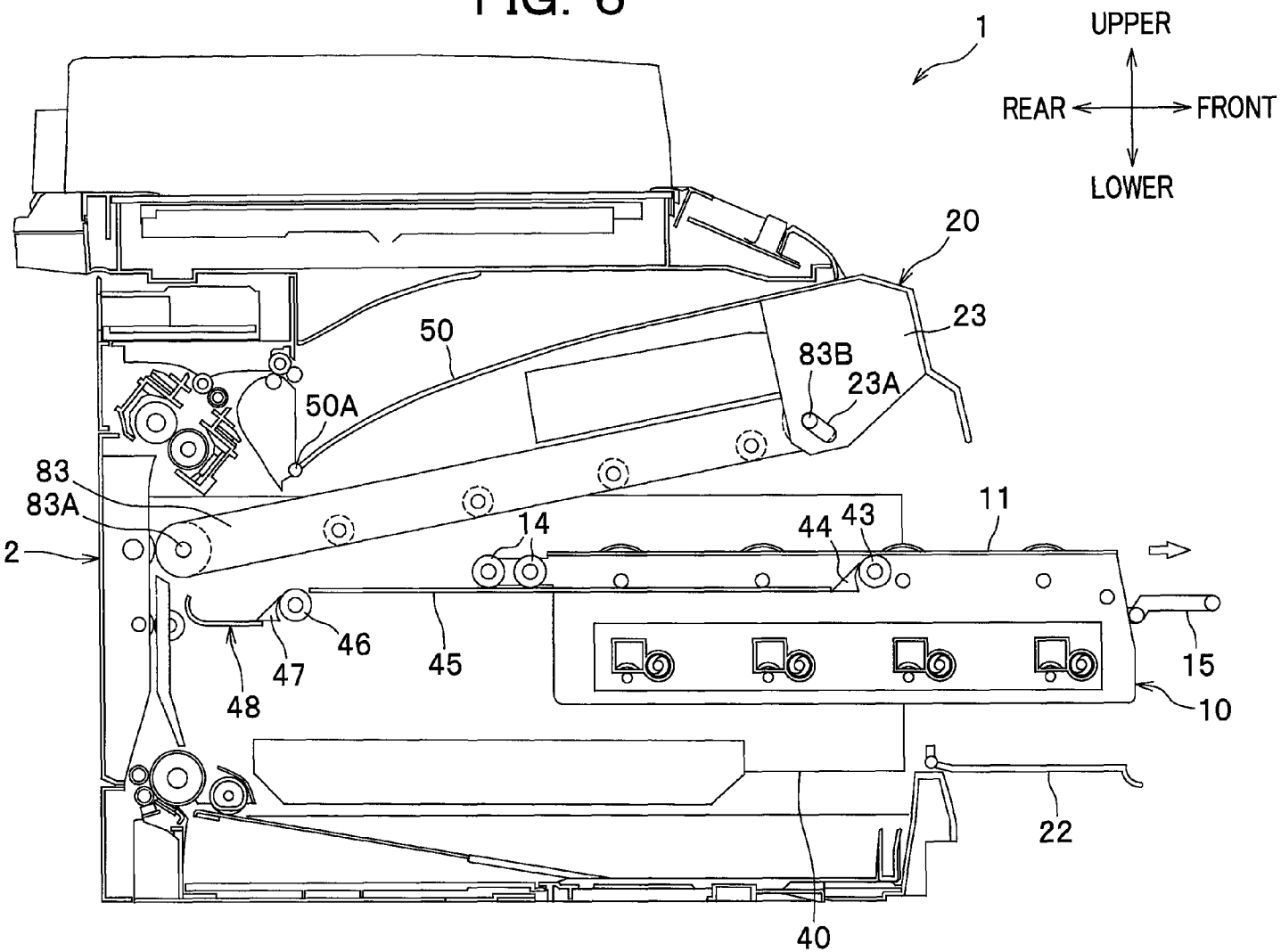
FIG. 6 is a diagram illustrating a state in which the support frame of the color printer of FIG. 1 is being pulled out.

When the support frame 10 is further pulled to the front by means of the handle 15, the guide rollers 14 roll on the second roller 46 and the guide rail 45, and the flange 11 makes the first roller 43 rotate, so that the support frame 10 moves to the front, i.e., substantially horizontally in a direction of the arrangement of the photoconductor drums 74 (as indicated by an arrow), as shown in FIG. 6.

When the support frame 10 is further pulled to the front, although not illustrated, the guide rollers 14 are guided by the first guide 44 to move in an obliquely upward and frontward direction, and roll on the first roller 43, so that the support frame 10 is pulled out completely from the side frame 40. In this way, the support frame 10 can be removed from the body casing 2.

When the support frame 10 is renewed (e.g., by replacing any of the development devices 71 with new one) and installed into the body casing 2, first, the guide rollers 14 are placed on the first roller 43 and the support frame 10 is pushed to the rear, the guide rollers 14 are moved to the first guide 44 with the help of the rolling motion of the rollers 14 and 43, and guided by the first guide 44 to move in an obliquely downward and rearward direction along the first guide 44. When the support frame 10 is further pushed in, the guide rollers 14 roll on the guide rail 45, and the flange 11 makes the first roller 43 rotate, so that the support frame 10 substantially horizontally moves to the rear (see FIG. 6).

Figure 5:
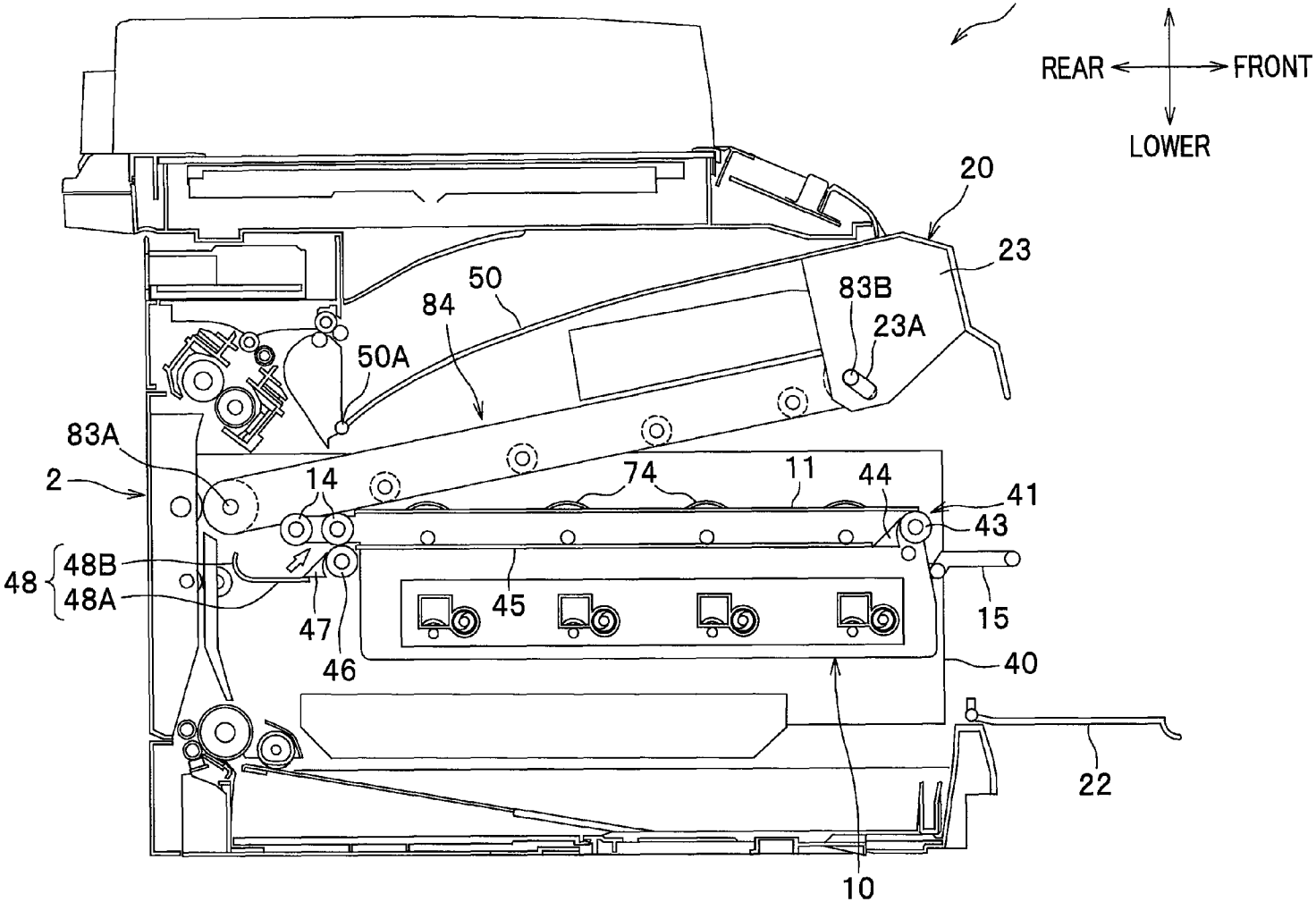
FIG. 5 is a diagram illustrating a state in which the support frame of the color printer of FIG. 1 has been moved upward.

The guide rollers 14 having arrived at a rear end of the guide rail 45 are brought into contact with the second roller 46, moved to the second guide 47 with the help of the rolling motion of the rollers 14 and 46, and guided by the second guide 47 to move in an obliquely downward and rearward direction along the second guide 47 (see FIG. 5). Then, as shown in FIG. 4, the rear guide roller 14 is brought into contact with the rear-end segment 48B of the positioning portion 48, and the support frame 10 is retained and prevented from moving, while the two guide rollers 14 are supported on the flat segment 48A so that the support frame 10 is positioned at its rear end within the body casing 2.

Each projection 12 of the support frame 10 is inserted on its way to the rear into the guide recess 42 and guided thereby to, move substantially horizontally along the flat section 42A. Further, when the guide rollers 14 are guided by the second guide 47 to move in an obliquely downward and rearward direction, the projection 12 is guided by the guide recess 42 to move in an obliquely downward and rearward direction along the sloped section 42B. Then, the projection 12 is brought into contact with the rear end of the sloped section 42B, and the support frame 10 is positioned at its front end within the body casing 2.

When the support frame 10 is positioned relative to the body casing 2, the underside of the flange 11 comes in contact with the upper surface of the guide rail 45; therefore, the support frame 10 is stably supported on the side frame 40 (body casing 2).

In this way, according to the present embodiment, the guide rollers 14 roll on the guide rail 45 while the flange 11 makes the first roller 43 rotate to thereby allow the support frame 10 to move in a substantially horizontal direction; therefore, the support frame 10 can be removed and installed with increased ease. Furthermore, according to the present embodiment, when the support frame 10 is installed, the guide rollers 14 are guided along the second guide 47 in an obliquely downward and rearward direction until the rear guide roller 14 is brought into contact with the rear-end segment 48B of the positioning portion 48 so that the support frame 10 is prevented from moving any further. Therefore, the support frame 10 after installation can be prevented from moving frontward and rearward. In this way, the positions of the photoconductor drums 74 supported by the support frame 10 can be determined accurately within the body casing 2, and thus the balance between the intermediate transfer belt 84 and each of the photoconductor drums 74 which are in contact with each other can be maintained substantially constant, with the result that a sufficient level of quality of images formed in the color printer 1 can be maintained without fail.

According to the present embodiment, since the upper cover assembly (the upper cover 20 together with the intermediate transfer belt 84) is configured to be swingable upward, the intermediate transfer belt 84 can be easily moved from the contact position to the separate position. Moreover, since the intermediate transfer belt 84 is configured to be swingable on the shaft 83A located in a position closer to a rear end of the intermediate transfer belt 84, the intermediate transfer belt 84 can be moved to the separate position without interfering with the fixing unit 9 disposed above the second transfer roller 86.

According to the present embodiment, since the intermediate transfer belt 84 and the sheet output tray 50 are configured to be swingable together, the sheet output tray 50 does not restrict the swinging motion of the intermediate transfer belt 84, and thus the distance of the swinging motion of the intermediate transfer belt 84 can be designed to be long enough to make the intermediate transfer belt 84 and each of the photoconductor drums 74 separate sufficiently from each other. Moreover, since the sheet output tray 50 is configured to be swingable on the shaft 50A located in a position closer to the rear end of the sheet output tray 50 (upper cover 20), the intermediate transfer belt 84 can be moved to the separate position even when sheets P are stacked on the sheet output tray 50.

Furthermore, according to the present embodiment, since the intermediate transfer belt 84 and the cleaning unit 87 are rendered movable (swingable) together, the intermediate transfer belt 84 (upper cover 20) can be swung without the need for removing the cleaning unit 87. Therefore, the ease of operation upon removing (for renewing or changing) the support frame 10 is improved.

Although the exemplary embodiment of the present invention has been described above, it is to be understood that the present invention is not limited to the above-described embodiment. For specific implementations, various changes and modifications may be made to the exemplary embodiment of the present invention without departing from the scope of the present invention as defined in the appended claims.

For example, a color printer 1 (so-called all-in-one or multifunction printer) having an image reading device (scanner) disposed above the body casing 2 is illustrated in the drawings (though the image reading device is not designated by reference numeral) as one example of an image forming apparatus according to the embodiment of the present invention, but the present invention is not limited thereto. In other words, the present invention is also applicable to a photocopier, a printer without an image reading device, or anything like that.

In the above-described embodiment, the shaft 83A which is coaxial with the shaft (axis of rotation) of the driving roller 81 of the intermediate transfer belt 84 is employed as an example of the first axis on which the intermediate transfer belt 84 is configured to be swingable; however, the present invention is not limited to this particular configuration. For example, the first axis of the swinging motion of the intermediate transfer belt 84 may be located in any position closer to a rear end of the belt frame 83 (or closer to one end of the arrangement of the plurality of photoconductors 74 when the intermediate transfer belt 84 is in the contact position). In the particular embodiment where the first axis is located on the same axis as that of the shaft of the driving roller 81 of the intermediate transfer belt 84, adverse effects conceivable of the swinging motion of the intermediate transfer belt 84 on a driving system of the intermediate transfer belt 84 can be suppressed. Furthermore, a planetary gear train or similar mechanism which would otherwise be required can be omitted, so that the driving system of the intermediate transfer belt 84 can advantageously be of a simple and compact structure.

In the above-described embodiment, the upper cover assembly (the upper cover 20 and components of the transfer unit 8 except the secondary transfer roller 86) is configured to have two shafts 50A and 83A, but the present invention is not limited this particular configuration. That is, the shafts on which the upper cover 20 and the components are configured to be swingable (axes of swinging motion) may be one and the same shaft (axis).

In the above-described embodiment, the support frame 10 is configured to be moved (guided) in an obliquely upward and frontward direction before it is allowed to be pulled out, but the present invention is not limited to this particular configuration. For example, the support frame 10 may be configured to be moved in a vertically upward direction before it is allowed to be pulled out. It is to be understood that such an upward movement of the support frame 10 may be performed by a user manually lifting the support frame 10 as in the above embodiment; optionally, a power source such as a motor may be used, or a compressed spring, and the like may be released, to move the support frame 10 upwardly.

In the above-described embodiment, the support frame 10 is moved in an obliquely upward direction and pulled out after the intermediate transfer belt 84 is moved from the contact position to the separate position, but the present invention is not limited to this particular configuration. The upward movement of the support frame 10 may be configured to be actuated in synchronization with the movement of the intermediate transfer belt 84 from the contact position to the separate position. Therefore, the present invention is to be construed to encompass any implementations in which a predetermined amount of upward movement of the support frame 10 is made when the intermediate transfer belt 84 is or comes in the separate position.

In the above-described embodiment, the intermediate transfer belt 84 is configured to be swingable from the contact position to the separate position, but the present invention is not limited to this particular configuration. For example, the intermediate transfer belt 84 may be configured to be subject to translational motion from the contact position to the separate position. With this configuration as well, the intermediate transfer belt 84 can easily be moved from the contact position to the separate position.

In the above-described embodiment, the photoconductor drum 74 is specifically illustrated as an example of a photoconductor, the support frame 10 shaped like a box with its upper side open as one example of a support frame 10, the guide rail 45 and second roller 46 as one example of a first guide part, and the second guide 47 and positioning portion 48 as one example of a second guide part. However, the present invention is not limited to these specific examples. For example, the first guide part may consist of a guide rail alone, while the second guide part may have a sloped portion (like the second guide 47) at an end of which a positioning portion (like a rear-end segment 48B of the positioning portion 48) is provided without a flat segment 48A so that the support frame 10 is configured to be retained at the end of the sloped portion of the second guide part; i.e., the second guide part may consist of an obliquely downwardly sloped portion (like a second guide 47) and a stopper or rear-end positioning segment (like a rear-end segment 48B) which are integrally formed in one piece. That is, it is to be understood that the materials and structures may be changed or modified where appropriate without departing from the scope of the present invention.

What is claimed is:

1. An image forming apparatus comprising:

a plurality of photoconductors;

a support frame configured to support the plurality of photoconductors arranged in the apparatus, the support frame being allowed to be pulled out from a casing of the apparatus; and an intermediate transfer belt disposed above the plurality of photoconductors and configured to be movable between a contact position in which the intermediate transfer belt is in contact with each of the plurality of photoconductors and a separate position in which the intermediate transfer belt is separate from the each of the plurality of photoconductors, wherein a predetermined amount of upward movement of the support frame made when the intermediate transfer belt is or comes in the separate position renders the support frame operable to be pulled out in a direction of arrangement of the plurality of photoconductors.

2. An image forming apparatus according to claim 1, further comprising a guideway portion provided in the casing of the apparatus, the guideway portion being configured to guide the support frame in a manner that permits the support frame to be pulled out;

wherein the guideway portion comprises a first guide part extending horizontally, and a second guide part comprising a sloped portion extending from an end of the first guide part facing toward a direction opposite to a pull-out direction in which the support frame is configured to be pulled out, in an obliquely downward direction which tilts toward the direction opposite to the pull-out direction; and wherein the support frame is configured to be retained at an end of the sloped portion of the second guide part facing toward the direction opposite to the pull-out direction.

3. An image forming apparatus according to claim 2, wherein the second guide part further comprises a positioning portion disposed at the end of the sloped portion.

4. An image forming apparatus according to claim 1, wherein the intermediate transfer belt is configured to be swingable from the contact position to the separate position.

5. An image forming apparatus according to claim 4, further comprising:

a cover configured to openably close an opening of the casing of the apparatus through which the support frame is allowed to be pulled out; and a cover restriction member configured to be swingable together with the intermediate transfer belt, wherein the cover is prevented from being opened by the cover restriction member when the intermediate transfer belt is in the contact position.

6. An image forming apparatus according to claim 4, further comprising an output sheet receptacle disposed above the intermediate transfer belt, wherein the output sheet receptacle is configured to be swingable together with the intermediate transfer belt.

7. An image forming apparatus according to claim 6, further comprising a support member configured to support the intermediate transfer belt, the support member being fixed to the output sheet receptacle;

wherein the intermediate transfer belt is configured to swing on a first axis thereof that is located in a first position closer to one end of the arrangement of the plurality of photoconductors when the intermediate transfer belt is in the contact position;

wherein the output sheet receptacle is configured to swing on a second axis thereof that is located in a second position closer to the one end of the arrangement of the plurality of photoconductors when the intermediate transfer belt is in the contact position; and wherein one of the intermediate transfer belt and the support member is provided with a support projection and the other of the intermediate transfer belt and the support member is provided with a support hole, the support projection being loosely fitted in the support hole.

8. An image forming apparatus according to claim 7, wherein the support hole is formed to have a shape that permits the support projection to move in directions toward and away from the second axis.

9. An image forming apparatus according to claim 1, further comprising a residual developer collecting member disposed opposite to the intermediate transfer belt and configured to collect developer remaining on the intermediate transfer belt, wherein the residual developer collecting member is movable together with the intermediate transfer belt.

10. An image forming apparatus comprising:

a plurality of photoconductors;

a support frame configured to receive the plurality of photoconductors arranged in the apparatus, the support frame being allowed to be pulled out from a casing of the apparatus; and an intermediate transfer belt disposed above the plurality of photoconductors and configured to be movable between a contact position in which the intermediate transfer belt is in contact with each of the plurality of photoconductors and a separate position in which the intermediate transfer belt is separate from the each of the plurality of photoconductors, wherein a predetermined amount of upward movement of the support frame made when the intermediate transfer belt is or comes in the separate position renders the support frame operable to be pulled out in a direction of arrangement of the plurality of photoconductors.

11. An image forming apparatus according to claim 10, further comprising a guideway portion provided in the casing of the apparatus, the guideway portion being configured to guide the support frame in a matter that permits the support frame to be pulled out;

wherein the guideway portion comprises a first guide part extending horizontally, and a second guide part comprising a sloped portion extending from an end of the first guide part facing toward a direction opposite to a pull-out direction in which the support frame is configured to be pulled out, in an obliquely downward direction which tilts toward the direction opposite to the pull-out direction; and wherein the support frame is configured to be retained at an end of the sloped portion of the second guide part facing toward the direction opposite to the pull-out direction.

12. An image forming apparatus according to claim 11, wherein the second guide part further comprises a positioning portion disposed at the end of the sloped portion.

13. An image forming apparatus according to claim 10, wherein the intermediate transfer belt is configured to be swingable from the contact position to the separate position.

14. An image forming apparatus according to claim 13, further comprising an output sheet receptacle disposed above the intermediate transfer belt, wherein the output sheet receptacle is configured to be swingable together with the intermediate transfer belt.

15. An image forming apparatus according to claim 14, further comprising a support member configured to support the intermediate transfer belt, the support member being fixed to the output sheet receptacle;

wherein the intermediate transfer belt is configured to swing on a first axis thereof that is located in a first position closer to one end of the arrangement of the plurality of photoconductors when the intermediate transfer belt is in the contact position;

wherein the output sheet receptacle is configured to swing on a second axis thereof that is located in a second position closer to the one end of the arrangement of the plurality of photoconductors when the intermediate transfer belt is in the contact position; and wherein one of the intermediate transfer belt and the support member is provided with a support projection and the other of the intermediate transfer belt and the support member is provided with a support hole, the support projection being loosely fitted in the support hole.

16. An image forming apparatus according to claim 15, wherein the support hole is formed to have a shape that permits the support projection to move in directions toward and away from the second axis.

17. An image forming apparatus according to claim 13, further comprising:

a cover configured to openably close an opening of the casing of the apparatus through which the support frame is allowed to be pulled out; and a cover restriction member configured to be swingable together with the intermediate transfer belt, wherein the cover is prevented from being opened by the cover restriction member when the intermediate transfer belt is in the contact position.

18. An image forming apparatus according to claim 10, further comprising a residual developer collecting member disposed opposite to the intermediate transfer belt and configured to collect developer remaining on the intermediate transfer belt, wherein the residual developer collecting member is movable together with the intermediate transfer belt.

* * * * *